United States Patent [19]

Yamac

[11] Patent Number: 4,890,395

[45] Date of Patent: Jan. 2, 1990

[54] HAIR DRYER

[75] Inventor: Yücel Yamac, Graz, Austria

[73] Assignee: Braun Aktiengesellschaft, Kronberg, Fed. Rep. of Germany

[21] Appl. No.: 127,668

[22] PCT Filed: Mar. 3, 1987

[86] PCT No.: PCT/DE87/00087

§ 371 Date: Jan. 4, 1988

§ 102(e) Date: Jan. 4, 1988

[87] PCT Pub. No.: WO87/05194

PCT Pub. Date: Sep. 11, 1987

[30] Foreign Application Priority Data

Mar. 5, 1986 [AT] Austria ..... 560/86

[51] Int. Cl.[4] ..... A45D 20/06

[52] U.S. Cl. ..... 34/96

[58] Field of Search ..... 34/96, 97, 90, 91

[56] References Cited

U.S. PATENT DOCUMENTS 4,321,934 3/1982 Diederich .

FOREIGN PATENT DOCUMENTS 8311607 3/1983 European Pat. Off. .
1557332 9/1969 Fed. Rep. of Germany .
2423726 11/1979 France .
62-2904 8/1987 Japan .
1172 of 1909 United Kingdom .
2170705 8/1986 United Kingdom ..... 34/96

*Primary Examiner*—Henry A. Bennet
*Attorney, Agent, or Firm*—Fish & Richardson

[57] ABSTRACT

The invention is directed to a hair dryer in which the heating device, the switch, the igniting mechanism and the gas tank are provided by a conventional gas-operated pocket lighter (17) preferably equipped with a battery ignition or piezoquartz ignition or, in an alternative embodiment, by a disposable lighter using flint ignition (40). It is also within the scope of the invention to use an exchangeable gas tank, with the igniting device being fixedly arranged in the hair dryer housing. The ignition process is started as the lighter (17 or 40) is inserted into the recess (21 or 21*a*) of the hair dryer housing, with the blower (2) being started briefly before by contact of the laminae (18 or 18*a*). The blower current is supplied by either disposable batteries or rechargeable accumulators. The hair dryer of the invention is turned off simply by easing the thumb pressure, which ensures at the same time that the appliance does not continue running accidentally when put away. If desired, the lighter (17 or 40) can be withdrawn from the hair dryer housing (1) for further customary use. By virture of its complete independence of electrical outlets, the hair dryer of the invention is perfectly safe for use in a wet environment and ready for use anywhere. In addition, its low weight and compact dimensions make it ideal for travelling. The appliance affords simple and low-cost manufacture.

20 Claims, 5 Drawing Sheets

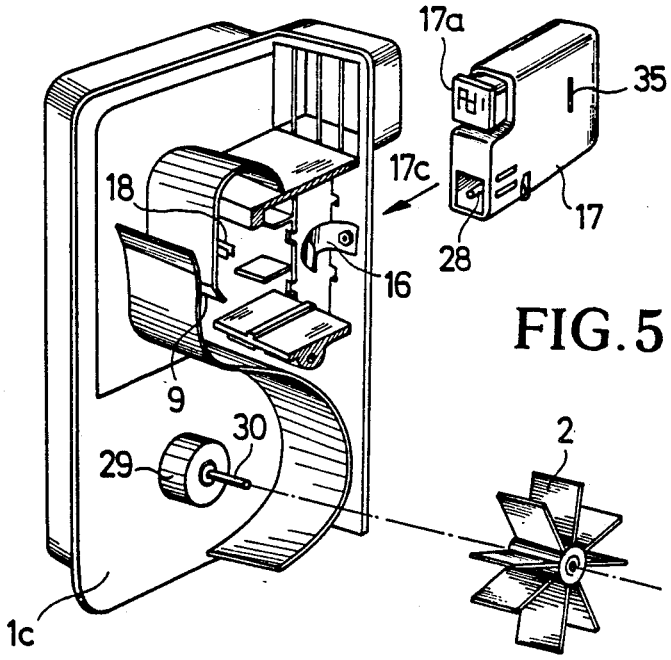
FIG. 5
FIG. 6
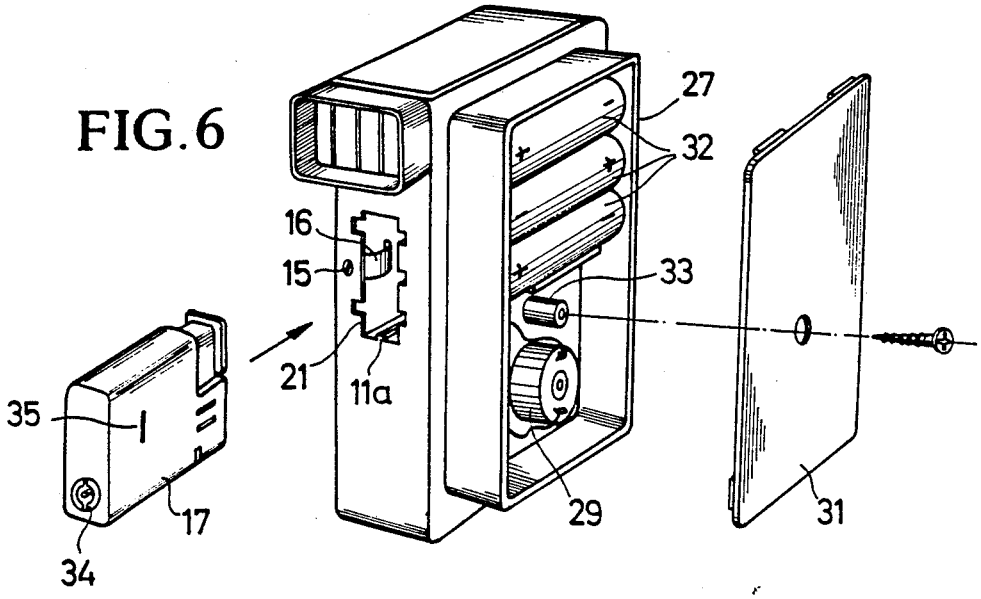

HAIR DRYER

This invention relates to a hair dryer according to the preamble of the main claim.

The current state of the art includes hair dryers having either a gas tank and a complicated control and ignition mechanism or a heat accumulator provided with heating wires. Both versions have a high weight and complicated expensive components. They are awkward to handle and not very convenient for travelling.

Based on this state of the art, the object underlying the present invention is to design a hair dryer which is suitable for travelling, safe, light weight and simple, using a conventional disposable or quartz pocket lighter or an exchangeable gas tank.

In accordance with the invention, this object is accomplished by a hair dryer incorporating the feature of the main claim. In a hair dryer housing equipped with an intake and an exit vent as well as a battery-operated blower, an ordinary gas-operated pocket lighter or a gas tank constituting the heat-producing part is used. The lighter or the gas tank is to be inserted into the hair dryer housing through a recess such that the thumb pressure applied to the base causes actuation of the gas lever on the gas lever abutment tab, the gas lever incorporating both the igniting and the gas discharge functions. The lighter or gas tank serves at the same time for actuation of a switch, starting also the blower briefly before ignition takes place. The air guide plate received in the housing cooperates with the air baffle plate to form a connecting clearance between the receptacle and the airflow channel having a curve in the direction of the hot air exit nozzle. The gas burns in the connecting clearance in such a manner that, due to the supply of air or oxygen, an ideal combustion leaving no residues takes place. The resulting heating of the airflow is sufficient for drying the hair.

The hair dryer of the invention affords the following advantages and effects:

a. Safety, because it obviates the need for an electricity supply;

b. Independence of limited cord lengths and different electrical outlet versions in different countries; as a result, ready for use anywhere, as, for example, in the car, on campsites, beaches, etc.;

c. Dimensions hardly larger than a pack of cigarettes and low weight (prototypes weigh about 250 g, which is about 30% less than the weight of conventional travel dryers);

d. No need to wait until the air flow is heated; hot air is delivered promptly;

e. When the appliance is not in use, the lighter or the gas tank may be withdrawn to be employed as usual; with the lighter removed, the hair dryer is completely safe, even in the hands of children;

f. No flames emerging from the hot air exit nozzle because the supply of fresh air or oxygen reduces the size of the lighter flame to about one tenth of its original length, the flame burning ideally in the connecting clearance. Since the ignition process is initiated after the blower is turned on, the partial vacuum prevailing in the combustion chamber ensures a safe ignition by preventing detonations. Thus, the excess pressure normally resulting from the ignition of gas does not cause the gas flame to be extinguished;

g. As soon as the air exit nozzle of the hair dryer becomes blocked by hair or some other object, the flame will be extinguished immediately. This is accomplished in that the air which accumulates as a result of the blocked hot air exit nozzle blows the lighter flame out by flowing back through the connecting clearance. Thereby, additional safety is ensured;

h. The heat-producing gas lighter or gas tank may be recharged or, where a disposable lighter or disposable gas tank is used, exchanged whenever necessary;

i. The thermodot applied to the surface of the housing provides a visual safety feature. Should a critical temperature be attained for any reason, the thermodot will change its color. In this event, the appliance has to be turned off. This is achieved by easing thelight thumb pressure applied to the lighter. Thus, the spring pressure of its gas lever causes the lighter to retract from its position a few millimeters, thereby interrupting both the supply of gas and the operation of the blower. The appliance will also turn off when released from one's hand or put away. This ensures that the appliance does not continue running inadvertently;

j. The hair dryer of the invention affords simple and low-cost manufacture.

An embodiment of the subject of the invention is illustr-ated in the accompanying drawings, in which:

FIG. 5 is a perspective side view of the housing (without the housing cover), together with the lighter and the removed blower propeller, taken at an angle from the rea;

FIG. 6 is a perspective view of the hair dryer and the lighter, with the battery box cover removed (view of the rear side, taken at an angle from the front);

Figure 1:
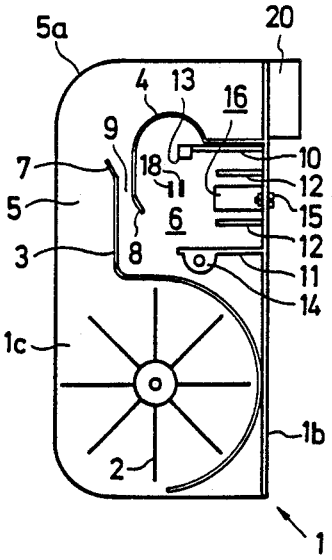
FIG. 1 is a schematic view of a hair dryer without the housing cover.

The hair dryer (1) shown in FIG. 1 schematically in a side view and without the housing cover includes a blower (2) and a lighter receptacle (6) separated from the airflow channel (5) by an air guide plate (3) and an air baffle plate (4). The free end (7) of the air guide plate (3) is bent into the airflow channel (5), while the free end (8) of the air baffle plate (4) is bent into the lighter receptable (6). The two free ends (7, 8) form a connecting clearance (9) between the airflow channel (5) and the lighter receptacle (6). The lighter receptacle (6) includes two lighter guide rails (12) and boundary ledges (10, 11). The boundary ledge (10) provided adjacent to the air baffle plate (4) includes a gas lever abutment tab (13). The boundary ledge (11) provided adjacent to the blower has a mounting device (14) for the housing cover (1a, FIG. 3). The spring plate (16) secured to the end surface (1b) by means of a screw (15) acts upon the inserted lighter (17, FIG. 2). The laminae (18) arranged inside the lighter receptacle (6) serve for contact of the blower current line.

Figure 2:
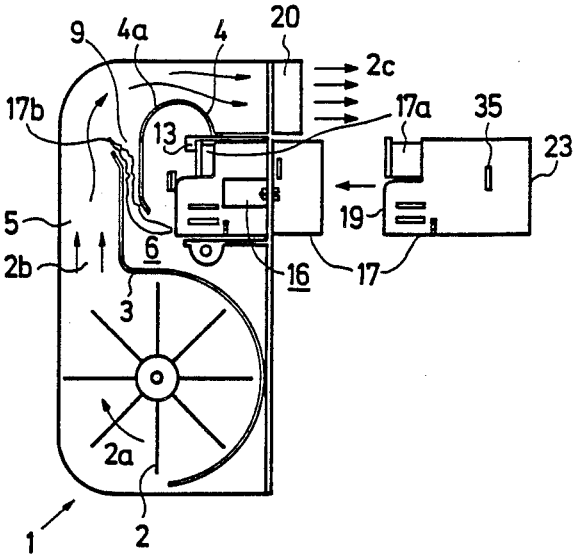
FIG. 2 is a schematic side view of the hair dryer and the inserted lighter in operating position (without the housing cover)

FIG. 2 shows a schematic side view of the hair dryer (1), with the lighter (17) inserted and the housing cover removed. The gas lever (17a) of the lighter is in abutting engagement with the gas lever abutment tab (13) of the boundary ledge (10) such that the gas lever (17a) yields on further insertion of the lighter (17) into the housing (1), causing the gas to be both discharged and ignited. Briefly before, the end surface (19) of the lighter (17) presses the laminae (18) of the blower current line together, causing the blower (2) to start rotating in the direction of arrow (2a). The blower sucks in the air normal to the plane of the drawing, discharging it through the airflow channel (5) in the direction of arrows (2b) out of the hot air exit nozzle (20). As a result of the blower airflow in the airflow channel (5), a suction effect is produced in the connecting clearance (9), causing fresh air to be drawn into the lighter receptacle (6) through the recess (21, FIG. 4), particularly through the lighter cooling slots (22, FIG. 4). As a result, the lighter (17) is cooled and the lighter flame (17b) receives more oxygen per unit of time, permitting a combustion without any residues. The combustion takes place in the connecting clearance (9). The heat thereby produced is drawn into the airflow channel (5) and mixed with the blower air by means of the curve (5a) and the semicircular bend (4a) of the air baffle plate (4), the resulting hot air (2c) being discharged through the hot air exit nozzle (20). In a practical test of the appliance, air temperatures of around 70° C. were measured on the hot air exit nozzle, which correspond to the temperature values of conventional hair dryers.

Figure 3:
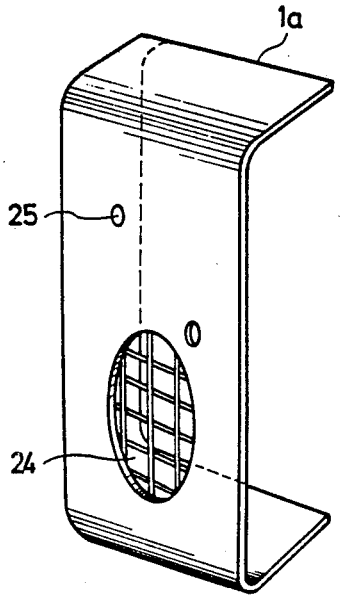
FIG. 3 is a perspective view of the housing cover.

FIG. 3 shows the housing cover (1a) with the air intake vent (24) and the thermodot (25) changing its color in case of overheating. The housing cover (1a) is configured in such a way that it provides in assembled condition an airtight seal on both the mounting surface (1c) and the edges of the air guide and baffle plates (3, 4).

Figure 4:
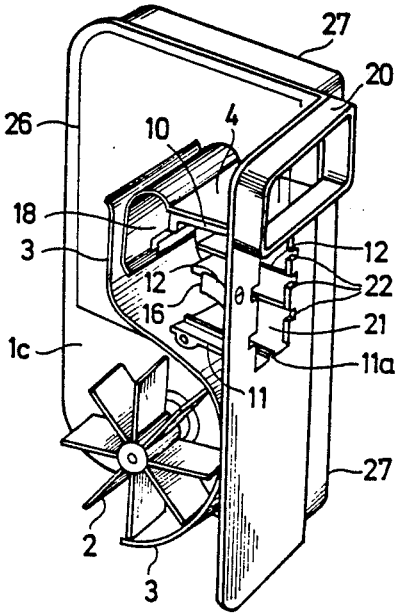
FIG. 4 is a perspective side view of the housing without the housing cover, taken at an angle from the front.

FIG. 4 is a perspective view of the hair dryer housing shown in FIG. 1 schematically, with the housing cover removed. As is best seen from this Figure, the air guide and air baffle plates (3, 4), the boundary ledges (10, 11) and the lighter guide rails (12) are arranged normal to the mounting surface (1c). A piece of aluminum sheet (26) serving as heat shield is fitted to the mounting surface (1c) and also to the inside of the housing cover (1a). The form of the recess (21) is adapted to fit the contours of the lighter (17) vertically to its longitudinal axis. A lighter spacing rail (11a) mounted on the boundary ledge (11) adjacent to the blower serves to prevent direct abutment of the lighter (17) with the boundary ledge (11) and to allow fresh air to flow into the lighter receptacle (6) to cool the lighter (17). In this Figure, the battery box (27) is to be seen on the rear side of the mounting surface (1c).

FIG. 5 is a perspective view of the hair dryer housing (1) without the housing cover (1a). In this Figure, the most essential components of the hair dryer of the invention are shown in a side view, taken at an angle from the rear. The lighter (17) is to be inserted into the recess (21) in the direction of the arrow (17c) such that the gas lever (17a) is at the top and the gas outlet valve (28) at the bottom thereof. In operation, the gas flows directly into the opening, adjacent to the lighter receptacle, of the connecting clearance (9) where the combustion process takes place. In this Figure, the motor (29) and its shaft (30) are shown with the blower (2) removed, so that the vertical position of the shaft axis relative to the mounting surface (1c) is made clear.

FIG. 6 shows the hair dryer together with the lighter (17), with the cover (31) of the battery box (27) being removed. The battery box (27) is configured to accommodate the batteries (32), the rear end of the motor (29) and the assembly column (33) of the cover (31). The lighter (17) is of the rechargeable type using a valve (34). A start mark (35) provided, where necessary, on the side of the lighter (17) provides a visual indication of the required insertion depth of the lighter (17) to start the hair dryer. The start mark (35) is shown in FIGS. 2, 5, 6 and 7.

Figure 7:
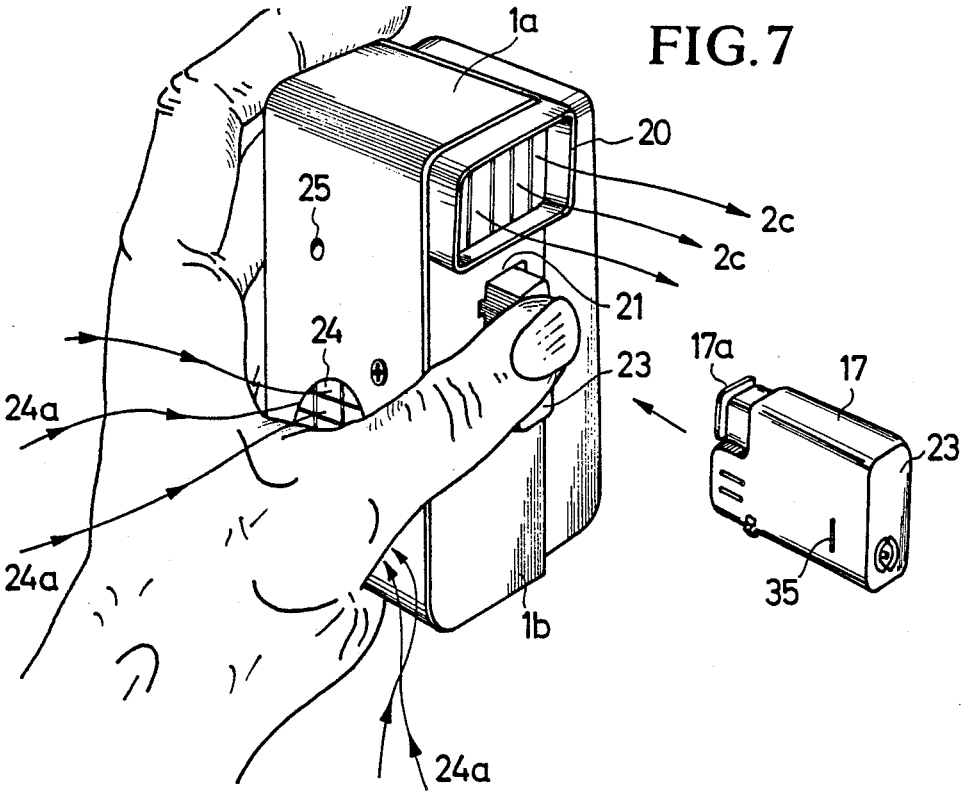
FIG. 7 is a perspective view of the hair dryer when in use (held by the left hand)
Figure 8:
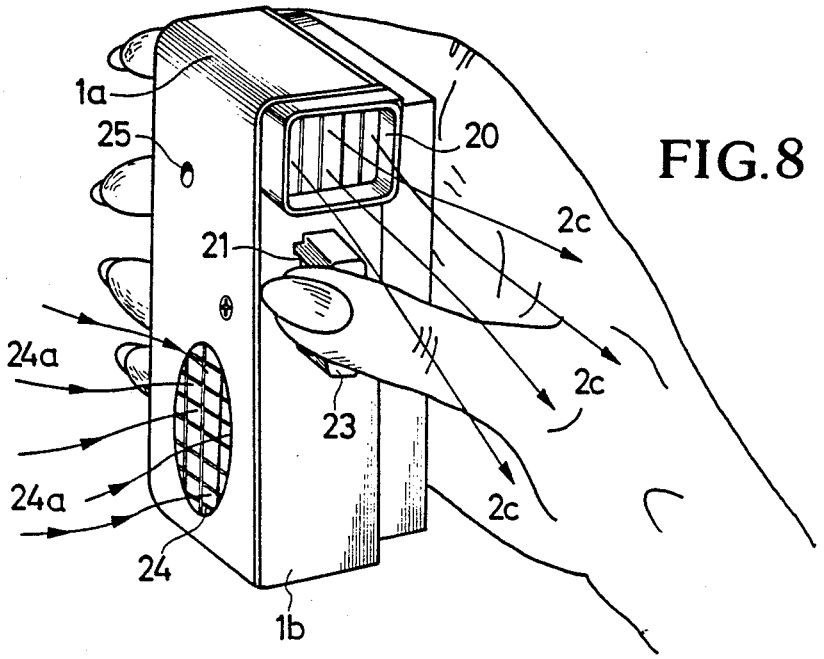
FIG. 8 is a perspective view of the hair dryer when held by the right hand (front view taken at an angle from the side)

FIGS. 7 and 8 show in perspective view the handling of the hair dryer when in operation. By inserting the lighter (17) into the recess (21) on the end surface (1b), the thumb pressure applied to the lighter base (23) starts the hair dryer such that gas discharge, gas ignition and starting of the blower occur approximately simultaneously. As initially described, the air (24a) sucked in through the air intake vent (24) is heated, being discharged through the hot air exit nozzle (20) in the direction of the arrows (2c). The counterpressure of the gas lever (17a) has to be overcome by a light thumb pressure. during the entire length of the hair drying process. This is necessary for safety reasons. As soon as the thumb pressure diminishes, the spring pressure of its gas lever (17a) causes the lighter (17) to retract from its position by a few millimeters, automatically shutting off the appliance. The pressure of the spring plate (16), however, retains the lighter (17) in its guideways in the hair dryer housing so that the lighter cannot accidentally drop out of the hair dryer housing. Following completion of the drying process, a slight pull imparted to the lighter removes it from the guideways in the housing so that it can be further used as usual. An additional visual safety feature is offered by the provision of a thermodot (25) on the housing cover (1a). The risk of flames emerging from the hot air exit nozzle (20) is eliminated because the supply of air or oxygen to the lighter flame results in an ideal combustion process, reducing the length of the lighter flame to about one tenth of its original length.

Figure 9:
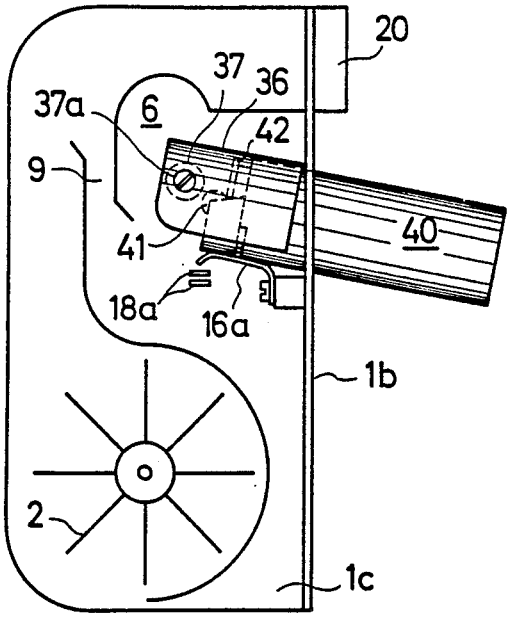
FIG. 9 is a view of the hair dryer in an embodiment using disposable lighters with flint ignition; schematic side view without the housing cover, but with the lighter inserted.
Figure 10:
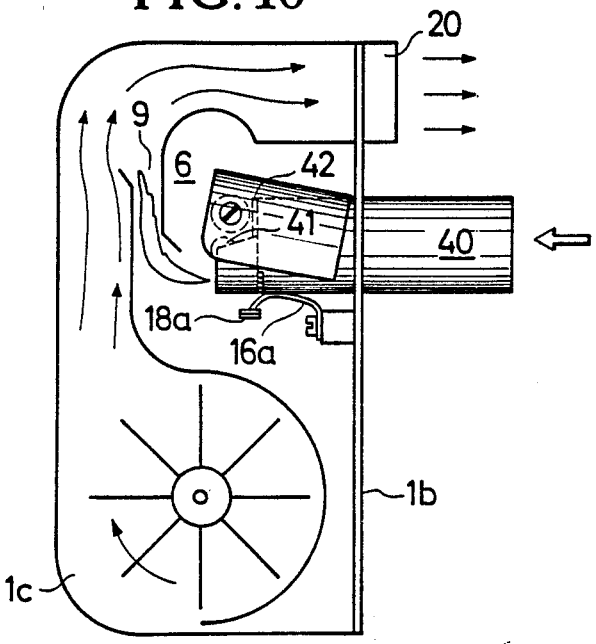
FIG. 10 is a view of the hair dryer for use with disposable lighters in operating position, schematic side view, without cover.

FIGS. 9 and 10 show the hair dryer of the invention without the housing cover in an embodiment using disposable lighters (40) with flint ignition. With the exception of the special U-guide (36), the position of the spring plate (16a) and the position of the laminae (18a), the hair dryer components shown and described in FIGS. 1 to 8 have remained identical. The U-guide (36) is equipped with a rubber cylinder (37). A screw (37a) extending through the rubber cylinder (37) and its nut (37b) secure it in position on the inside of the U-guide (36, FIGS. 9, 10, 11). The U-guide (36) is fastened to the mounting surface (1c) by means of screws (38, 39) in such a manner that the guide has its longitudinal axis at an angle to the end surface (1c) and its open side adjacent to the blower is bounded by the spring plate (16a). As the disposable lighter (40) is pressed into the U-guide (36), the igniting wheel (41) will rub against the rubber cylinder (37), the lighter (40) will be thrust in the direction of the spring plate (16a) until the gas lever (42) rests against the rubber cylinder (37), so that the gas lever is depressed causing gas to be discharged while at the same time the ignition process is started. During this process, the spring plate (16*a*) will bend such as to cause contact of the laminae (18*a*), thereby starting the blower (2) prior to the actual ignition (FIG. 10). The burning of the gas in the connecting clearance (9) and the discharge of hot air through the hot air exit nozzle (20) take place as in the preceding description.

Figure 11:
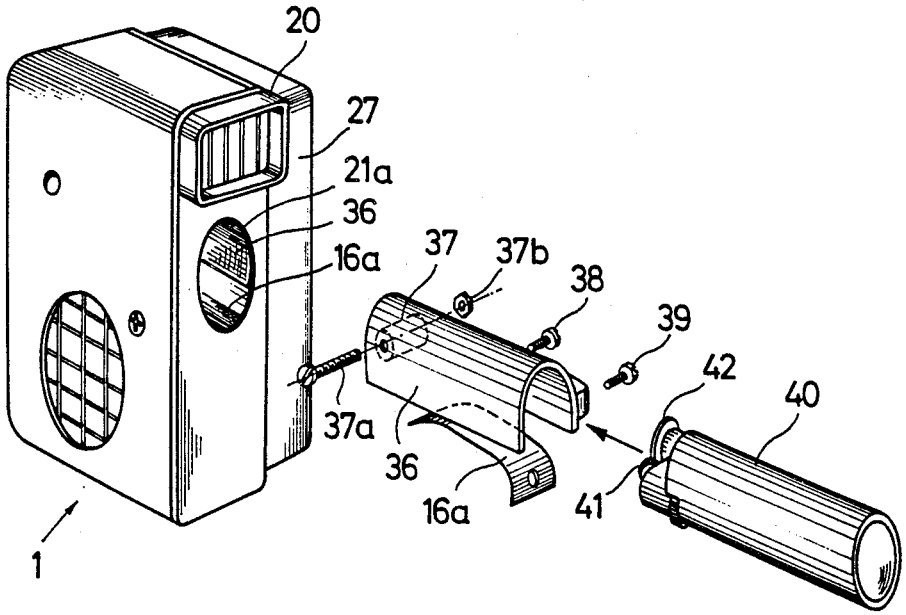
FIG. 11 is a perspective front view of the hair dryer for use with disposable lighters, taken at an angle from the side (with U-guide and disposable lighter).

FIG. 11 is a perspective view of the hair dryer of the invention, of the U-guide (36) and of the disposable lighter (40). As becomes apparent from this Figure, the form of the recess (21*a*) is adapted to fit the contours of the disposable lighter (40) transversely to its longitudinal axis.

It is to be understood that in all embodiments a gas tank may be readily substituted for the gas lighter, in which event the igniting device, which may be of any desired type, is fixedly arranged in the housing of the hair dryer. In this case, the igniting device is adapted to be operated either by a separate switch mounted on the hair dryer housing or by means of the gas tank by inserting it into the hair dryer.

I claim:

1. A hair dryer comprising a housing, structure in said housing defining an air inlet, an air outlet and an airflow channel between said inlet and said air outlet, blower structure in said housing and coupled to said air flow channel, receptacle structure in said housing for receiving fuel tank structure, actuator structure coupled to said receptacle structure and responsive to insertion of fuel tank structure into said receptacle structure for igniting a flow of fuel flow from said fuel tank, and structure in said housing defining a connecting passage between said receptacle structure and said airflow channel for producing a flow of hot air in said air flow channel in response to the ignited flow of fuel.

2. A hair dryer as claimed in claim 1 and further including an igniting mechanism and a fuel tank that are configured as a unit, for example, as a gas lighter, which is adapted to be inserted into said receptacle structure.

3. A hair dryer as claimed in claim 1 and further including igniting mechanism fixedly arranged in said hair dryer housing.

4. A hair dryer as claimed in any one of the preceding claims wherein said igniting mechanism is adapted to be operated by insertion of said fuel tank.

5. A hair dryer as claimed in either claim 2 or 3 wherein said igniting mechanism operates by battery or piezo or flint ignition.

6. A hair dryer comprising a housing, structure in said housing defining an air inlet, an air outlet and an airflow channel between said air inlet and said air outlet, blower structure in said housing and coupled to said air flow channel, receptacle structure in said housing that defines a housing opening for receiving fuel tank structure, structure in said housing defining a connecting passage between said receptacle structure and said airflow channel, said receptacle structure including two boundary ledges adjoining the edges of said housing opening and arranged normal to the surface of said housing in which said opening is disposed, with the boundary ledge adjacent to said connecting passage including a gas lever abutment tab.

7. A hair dryer as claimed in claim 6 wherein the boundary ledge adjacent to said blower structure includes a spacing rail and a mounting device for a housing cover.

8. A hair dryer as claimed in claim 6 wherein two guide rails are arranged between said boundary ledges in such a manner that, in extending parallel to said boundary ledges, they conform to the edge elevation of said housing opening.

9. A hair dryer as claimed in claim 8 and further including a spring plate in said receptacle structure that has a free, arcuate end directed towards said guide rails.

10. A hair dryer as claimed in claim 8 wherein the edges of said opening of said receptacle structure include a plurality of cooling slots.

11. A hair dryer as claimed in claim 1 wherein said airflow channel and said blower structure are separated from said receptacle structure by an air guide plate and an air baffle plate arranged vertically to a mounting surface, such that the respective free ends of said plates overlap to form said connecting passage therebetween.

12. A hair dryer as claimed in claim 11 wherein the airflow channel between the free end of said air guide plate and said air outlet has at least one curve, and said air baffle plate has a curvature corresponding to said curve of said air guide plate.

13. A hair dryer as claimed in claim 1 or claim 2 and further including a blower control circuit arranged in such a manner that said blower control circuit is closed by the end surface of said fuel tank or gas lighter on insertion of said fuel tank or gas lighter in said receptacle structure.

14. A hair dryer as claimed in claim 1 or claim 2 and further including a blower control circuit that is closed on insertion of said fuel tank or gas lighter prior to operation of said actuator structure.

15. A hair dryer as claimed in claim 1 or claim 2 wherein the longitudinal axis of said fuel tank or gas lighter in the hair dryer housing, the axis of said blower structure and the axis of said airflow channel are not arranged along a common line.

16. A hair dryer as claimed in either claim 1 or 2 wherein said dryer uses a disposable lighter and said receptacle structure includes a U-guide for the disposable lighter.

17. A hair dryer comprising a housing, structure in said housing defining an air inlet, an air outlet and an airflow channel between said air inlet and said air outlet, blower structure in said housing and coupled to said air flow channel, receptacle structure in said housing that defines a housing opening for receiving a disposable lighter, said receptable structure includes a U-guide for the disposable lighter, and the open side of said U-guide being directed towards said blower and bounded by a spring plate bent in L-shape and mounted on the inside of an end surface of said housing, structure in said housing defining a connecting passage between said receptacle structure and said airflow channel for producing a flow of hot air in said air flow channel in response to the ignited flow of fuel.

18. A hair dryer as claimed in claim 17 wherein at its end remote from the opening, said U-guide for the disposable lighter includes a rubber cylinder whose longitudinal axis is arranged normal to the sides of said U-guide and in a plane with the axis of rotation of the igniting wheel of the disposable lighter inserted into said U-guide, said plane extending parallel to the longitudinal axis of said U-guide.

19. A hair dryer as claimed in either claim 1 or 2 wherein said disposable lighter is provided with a start mark.

20. A hair dryer as claimed in either claim 1 or 2 and further including a heat-insulating material, preferably aluminum sheet, fitted to the inside of said housing and to the mounting surface in the area of said connecting passage.

* * * * *